United States Patent [19]

Broderick et al.

[11] Patent Number: 4,786,191

[45] Date of Patent: Nov. 22, 1988

[54] DRAW TAPE BAG WITH TWO SINGLE DRAW TAPES AND METHOD OF MANUFACTURE

[75] Inventors: Kevin Broderick, Victor; Vernon C. Catchman, Palmyra; Fox J. Herrington, Holcomb; Shirley K. Johnston, Sodus Point, all of N.Y.; Robert H. Olson, Beaufort, S.C.; Donald Stell, Palmyra, N.Y.

[73] Assignee: Mobil Oil Corporation, New York, N.Y.

[21] Appl. No.: 100,649

[22] Filed: Sep. 24, 1987

[51] Int. Cl.[4] ..... B65D 33/28

[52] U.S. Cl. ..... 383/75; 383/72; 493/225

[58] Field of Search ..... 383/75, 71, 72, 76, 383/92, 908; 493/203, 211, 215, 225

[56] References Cited

U.S. PATENT DOCUMENTS

| | | | |
|---|---|---|---|
| 463,597 | 11/1891 | Cussen | 383/75 |
| 3,552,639 | 1/1971 | Meyer | 383/75 |
| 4,260,003 | 4/1981 | Hendrickson | 383/72 |
| 4,628,536 | 12/1986 | Herrington | 383/75 |

FOREIGN PATENT DOCUMENTS

| | | | |
|---|---|---|---|
| 1183880 | 7/1959 | France | 383/75 |
| 1236831 | 6/1960 | France | 383/72 |

*Primary Examiner*—Willis Little

*Attorney, Agent, or Firm*—Alexander J. McKillop; Michael G. Gilman; Charles J. Speciale

[57] ABSTRACT

A draw tape bag with two single tapes has a front wall and back wall of flexible sheet material joined to each other along edges of the bag. Tubular channels extend along opposed transverse top edges of the front and back walls. The channels define an open mouth for the bag. Each of the channels has openings at the opposite ends of the top edges of the bag. A tape extends through each of the channels. One of the ends of each of the tape is attached to the opposite side edges of the bag beneath the openings in the channels and the other end of the tape extends through the respective opening at the other end of the channel so that the tapes cross in their respective channels, whereby when the tapes are pulled, the top of the bag is drawn tightly together. A method of forming this draw tape bag is also disclosed.

3 Claims, 1 Drawing Sheet

DRAW TAPE BAG WITH TWO SINGLE DRAW TAPES AND METHOD OF MANUFACTURE

FIELD OF THE INVENTION

The invention relates to the manufacture of flexible bags and particularly to the manufacture of draw tape bags from thermoplastic films having a tight closure.

RELATED APPLICATION

The present invention is related to the invention disclosed in our application entitled "Dual Draw Tape Bag and Method of Manufacture" Ser. No. 100648 incorporated herein by reference thereto and concurrently filed herewith on Sept. 24, 1982.

BACKGROUND OF THE INVENTION

Bags made of plastic film such as thin polyethylene film have been used in various sizes. Small bags are used in the packaging of sandwiches and the like; larger bags are used for shopping bags and even larger bags are used for containing trash. The present invention is particularly related to draw band bags having a tight closure.

A particularly advantageous closure for such bags includes a draw band or tape constructed from the same polyethylene material. Draw tape bags of this type have been known for several years and are described in various patents such as, for example, U.S. Pat. No. 3,029,853—Piazze. Bags of this type are formed by two pliable plastic sheets joined to one another on three sides and open at a fourth. A tubular hem is provided at the open end of each sheet and contains a pliable thermoplastic strip. A hole intermediate the ends of each hem exposes the strip in the hems allowing them to be pulled through the openings and used as a handle while simultaneously closing the open mouth of the bag. A similar type bag is disclosed in U.S. Pat. No. 4,624,654—Boyd et al. The draw tapes in the bags disclosed in these patents are at the same level in both hems of the bag. Draw tape bags using two single tapes at the same and different parallel levels in the bags are disclosed in U.S. Pat. No. 3,547,341—Kirkpatrick and Pat. No. 3,738,568—Ruda. In both of these patents the openings for pulling the draw tapes are at the opposite edges of the bag.

It is an object of the present invention to provide a draw tape bag having two single draw tapes, each of which is pulled from a different edge of the bag. The tapes are crossed within their respective bag hems so the mouth of the bag is drawn tightly closed.

SUMMARY OF THE INVENTION

In accordance with the present invention, there is provided a draw tape bag having a front wall and a back wall of flexible sheet material joined to each other along the edges of the bag. Tubular channels extend along opposed top edges of the front wall and the back wall, respectively, the channels defining an open mouth for the bag and each of the channels having openings at the opposite ends of the top edges of the bag. A tape extends through each of the channels, one end of each tape being attached to the opposite side edges of the bag beneath the openings in the channels and the other end of each tape extending through the respective opening at the other end of the channels so that the tapes cross in their respective channels whereby when the tapes are pulled, the top of the bag is drawn tightly together.

In accordance with another aspect of the invention the flexible sheet material and the tapes comprise thermoplastic film wherein the side edges of the bags and the ends of the tapes beneath the openings in the channels are joined together by heat seals.

Further in accordance with the invention there is provided a method of making a draw tape bag comprising the steps of providing a continuous length of flexible thermoplastic bag material folded once longitudinally having a longitudinal fold edge and two adjoining material layers each with a longitudinal free edge opposite the longitudinal fold edge. The method further includes folding the two longitudinal free edges respectively against the adjoining layer to provide a pair of longitudinal hems of double layer thickness opposite the longitudinal fold edge and providing a hole in each hem at predetermined intervals corresponding to the width of the bags to expose subsequently inserted draw tape. The method further includes inserting continuous strip thermoplastic draw tape into each hem, the tape being oscillated up and down for alternate bags so that the end of one tape in one hem is below the hole at one side of the bag and in line with the hole at the other side of the bag and the end of the other tape in the other hem is in line with the hole at the one side of the bag and below the hole at the other side of the bag. The method further includes longitudinally joining together the double layer thickness of each hem to form a channel along the longitudinal edge of each layer opposite the longitudinal fold containing the continuous draw tapes which cross in their respective channels, and transversely sealing and severing the flexible bag material and crossed draw tapes at the predetermined intervals along the length of the flexible bag material to separate individual draw tape bags from the continuous length of flexible thermoplastic bag material.

The foregoing and other objects, features and advantages of the invention will be better understood from the following more detailed description and appended claims.

DESCRIPTION OF THE PREFERRED EMBODIMENT

The plastic draw tape bags of the present invention may be made from either high density polyethylene or from linear low density polyethylene or equivalent plastic materials. In the preferred form of the invention the bags are formed from a tube of polyethylene which is oriented in the direction of extrusion. Such materials for plastic bags are disclosed in U.S. Pat. No. 4,558,463—Boyd. Apparatus suitable for manufacturing draw tape bags of the present invention is disclosed in U.S. Pat. No. 4,624,654—Boyd et al and the disclosure therein is incorporated herein by reference thereto.

Figure 1:
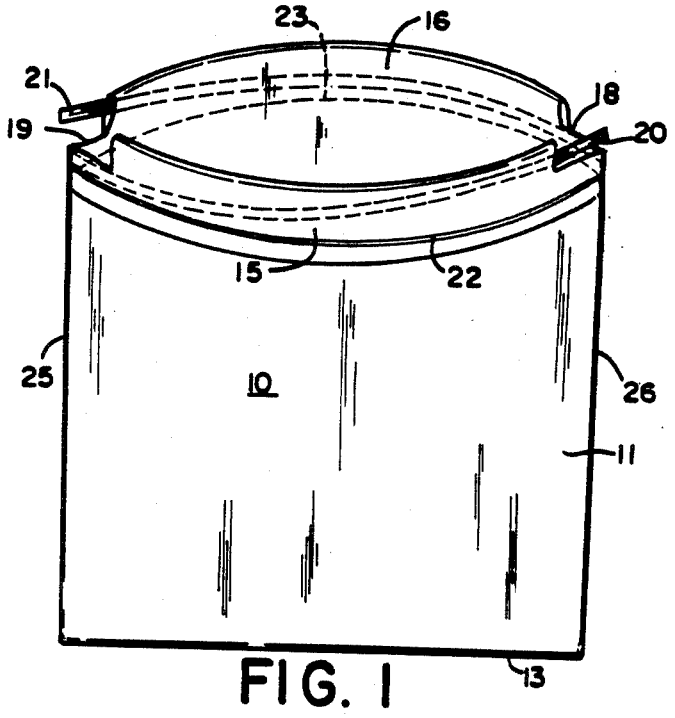
FIG. 1 is a perspective view of a draw tape bag with two single draw tapes embodying the present invention.
Figure 2:
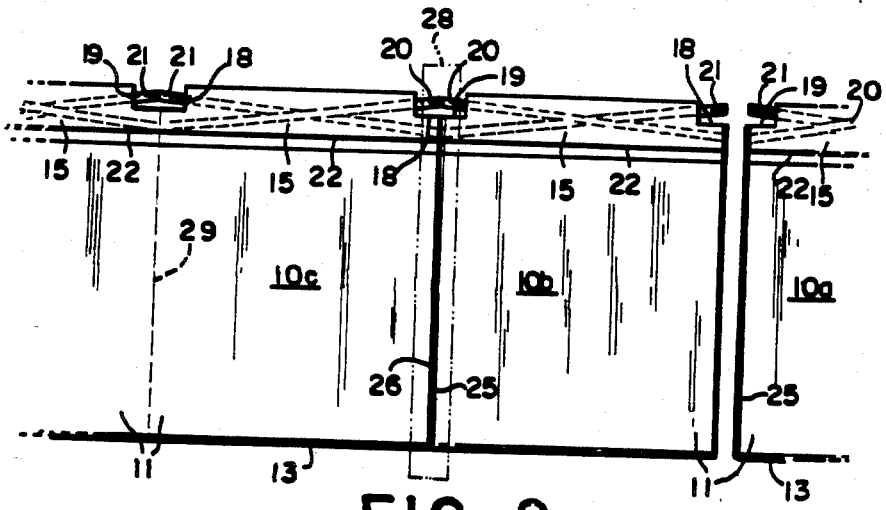
FIG. 2 is a view showing the method of manufacture of the draw tape bag illustrated in FIG. 1.

Referring to FIGS. 1 and 2 it will be seen that a draw tape bag 10 according to the present invention includes a front panel 11 and a rear panel 12. The two panels preferably are formed from a tube of polyethylene which is oriented in the direction of extrusion. The bottom 13 of the bag 10 may be formed by a fold or seal joining the front and back panels 11 and 12. The tube is slit along the top and the two longitudinal free edges are folded over respectively against the adjoining panels 11 and 12 to provide a pair of longitudinal hems 15 and 16 of double layer thickness opposite the longitudinal fold edge of bottom 13. As shown in FIGS. 1 and 2 the opposite ends of the hems 15 and 16 are provided with openings or holes 18 and 19. Each of the hems 15 and 16 is provided with a tape 20 and 21 respectively.

It will be noted that the tapes 20 and 21 cross each other within their respective hems 15 and 16. One end of the draw tape 20 in hem 15 is below the hole 19 at one side of the bag 10 and the other end of draw tape 20 is in line with the hole 18 at the other side of the bag 10. One end of the draw tape 21 in the hem 16 is below the hole 18 at one side of the bag 10 and in line with the hole 19 at the other side of the bag 10. After the draw tapes 20 and 21 have been inserted in the respective hems 15 and 16 the double layer thickness of each hem is longitudinally joined together along seal lines 22 and 23 to form a channel containing the respective draw tapes 20 and 21.

One end of the draw tape 20 in channel 15 is secured to one side of the bag 10 when the side heat seal 25 is made and one end of the draw tape 21 in channel 16 is secured to the opposite side of the bag 10 when the side heat seal 26 is made. The opposite or free end of the draw tape 20 extends through the opening 18 and the opposite or free end of the draw tape 21 extends through the opening 19.

After the hems have been heat sealed at 22 and 23 the flexible bag material and crossed tapes 20 and 21 are transversely sealed and severed at predetermined intervals, i.e. corresponding to bag width, along the length of the flexible bag material to separate individual draw tape bags from the continuous length of flexible thermplastic bag material. As shown in FIG. 2 the leading bag **10*a* has been severed from the continuous length of flexible thermoplastic bag material and the next bag 10*b* in the line is being sealed and concurrently severed as indicated by the sealing/cutting member diagrammatically illustrated at 28. A suitable seal/cutter assembly 28 is well known in the art as disclosed in the aforesaid U.S. Pat. No. 4,624,654. As shown in FIG. 2 the side edges of the next bag 10*c* will be sealed and cut at the dotted line 29** from the continuous length of flexible thermoplastic bag material.

In a preferred method of forming draw tape bags with two single draw tapes in accordance with the present invention, a continuous length of flexible thermoplastic bag material is folded once longitudinally to provide a longitudinal fold edge and two adjoining material layers each with a longitudinal free edge opposite the longitudinal free edge. The two longitudinal free edges are respectively folded against the adjoining layers to provide a pair of longitudinal hems 15 and 16 of double layer thickness opposite the longitudinal fold edge. While the free edges have been folded against the outer surfaces of the panels 11 and 12, FIGS. 1 and 2, it is to be understood that they may be folded against the inner surfaces of these panels. As shown in FIG. 2 the openings or holes 18 and 19 at the opposite ends of the hems in the bags **10*a*–10*c* are adjacent each other and thus both holes 18 and 19 for adjacent bags may be punched at the same time. The holes are punched at predetermined intervals corresponding to the width of the bags. After the hems have been formed a continuous strip thermoplastic draw tape 20 and 21 is inserted in crossed relation in the respective hems. The tapes are oscillated up and down for alternate bags, as shown in FIG. 2 so that one end of one tape in one hem is below the hole at one side of the bag and in line with the hole at the other side of the bag and one end of the other tape in the other hem is in line with the hole at the one end of the bag and below the hole at the other side of the bag. As illustrated in FIG. 2 draw tape 20 is oscillated up an down in the front hems 15 and draw tape 21 is oscillated up and down in the back hems 16 of the draw tape bags 10*a*–10*c*. After the crossed draw tapes have been inserted in the respective hems the double layer thickness of each hem is joined together by a heat seal to form a channel along the longitudinal edge of each layer opposite the longitudinal fold. As shown in FIG. 2** the continuous length of flexible thermoplastic bag material and crossed draw tapes are transversely sealed and severed at the predetermined intervals along the length of the flexible bag material to separate individual draw tape bags from the continuous length of flexible bag material.

Draw tape bags produced according to the present invention have numerous advantages. The bags are easy to draw closed since only single tapes are used and they are pulled in-line from the opposite ends of the bags rather than upward from the middle. Also single tapes have the advantage of being easier to tie and untie than dual tapes. Single tape bags are also less costly to manufacture as they use only half as much tape.

What is claimed is:

1. A dual draw tape bag which comprises:

a front wall and a back wall of flexible sheet material joined to each other along the edges of the bag;

tubular channels extending along opposed transverse top edges of said front wall and said back wall, respectively, said channels defining an open mouth for the bag, each of said channels having openings at the opposite ends of said top edges of the bag; and a tape extending through each of said channels, one end of each tape being attached to the opposite side edges of the bag beneath the openings in said channels and the other end of each tape extending through the respective opening at the other end of said chanenls so that the tapes cross in their respective channels whereby when the tapes are pulled, the top of the bag is drawn tightly together.

2. A draw tape bag according to claim 1 wherein said flexible sheet material and said tape comprise thermoplastic film.

3. A method of forming a draw tape bag comprising the steps of:

providing a continuous length of flexible thermoplastic bag material folded once longitudinally and having a longitudinal fold edge and two adjoining material layers each with longitudinal free edge opposite the longitudinal fold edge:

folding the two longitudinal free edges respectively against said adjoining layers to provide a pair of longitudinal hems of double layer thickness opposite said longitudinal fold edge;

providing a hole in each hem at predetermined intervals corresponding to the width of the bags to expose a subsequently inserted draw tape;

inserting a continuous strip thermoplastic draw tape into each hem, each said tape being oscillated up and down for alternate bags so that the end of one tape in one hem is below the hole at one side of the bag and in line with the hole at the other side of the bag and one end of the other tape in the other hem is in line with the hole at the one side of the bag and below the hole at the other side of the bag;

longitudinally joining together the double layer thickness of each hem to form a channel along the longitudinal edge of each layer opposite the longitudinal fold containing the continuous draw tapes which cross in their respective channels;

transversely sealing and severing the flexible bag material and crossed draw tapes at the predetermined intervals along the length of the flexible bag material to separate individual draw tape bags from the continuous length of flexible thermoplastic bag material.

* * * * *